US005494294A

United States Patent [19]

Cappetta

[11] Patent Number: 5,494,294

[45] Date of Patent: Feb. 27, 1996

[54] INTERACTIVE AMUSEMENT GAME AND REDEMPTION SYSTEM

[76] Inventor: Louis Cappetta, 170 N. Oberlin Ave., Lakewood, N.J. 08701

[21] Appl. No.: 328,024

[22] Filed: Oct. 24, 1994

[51] Int. Cl.[6] ..... A63F 3/06

[52] U.S. Cl. ..... 273/269; 273/141 A; 273/142 R; 273/454

[58] Field of Search ..... 273/453, 269, 273/270, 143 R, 142, 141, 445, 454

[56] References Cited

U.S. PATENT DOCUMENTS

| | | | |
|---|---|---|---|
| 2,463,139 | 3/1949 | Benker | 273/141 A |
| 4,378,940 | 4/1983 | Gluz et al. | 273/269 X |
| 4,875,686 | 10/1989 | Timms | 273/269 X |
| 4,889,339 | 12/1989 | Okada | 273/143 R |
| 5,007,649 | 4/1991 | Richardson | 273/269 X |
| 5,192,076 | 3/1993 | Komori | 273/454 X |
| 5,326,104 | 7/1994 | Pease et al. | 273/269 X |

FOREIGN PATENT DOCUMENTS

| | | | |
|---|---|---|---|
| 2231809 | 11/1990 | United Kingdom | 273/269 |
| 2232607 | 12/1990 | United Kingdom | 273/269 |

*Primary Examiner*—Paul E. Shapiro
*Attorney, Agent, or Firm*—Clifford G. Frayne

[57] ABSTRACT

An interactive amusement game and redemption system in which a central processing unit, control panel and plurality of players' desks are interconnected such that the operator of the control panel and the game is aware of the money deposited by each individual player, the number of cards selected by the player and the identity of those cards for play in the game, and the amount of the award to be dispensed and to which player(s), the same information being available to the player at each individual player's position through instantaneous display, the players seeking an award by starting and stopping a random number generator selectively, to match an indicia on the random number generator with an indicia on the player's playing card.

9 Claims, 3 Drawing Sheets

INTERACTIVE AMUSEMENT GAME AND REDEMPTION SYSTEM

BACKGROUND OF THE INVENTION

1. Field of the Invention

The present invention relates to amusement games and, in particular, to an interactive amusement game in which the player attempts to control the selection of random numbers in order to form a match, the player and operator are electrically interconnected providing the player with an instantaneous readout as to the quantity of his bank and the quantity of accumulated points and providing the operator with instantaneous information regarding the number of players, the identity of the cards being played by the players, and the amount of money deposited on a particular game.

2. Description of the Prior Art

The game of Bingo is a popular game in which a player attempts to match randomly drawn numbers with random numbers on a playing card in order to obtain a match either vertically, horizontally, diagonally or pattern-wise in order to win money or prizes. Traditionally, the random numbers selected in Bingo are manually selected from a rotating barrel and announced by the operator of the game. The operator controls the sale of the playing cards and the collection of money and the disbursement-of prizes in a substantially manual operation.

Applicant has developed an interactive game along the lines of Bingo in which the player's playing position is interconnected with the control panel and operator of the game and both are interactively connected witch a central processing unit. Additionally, the design of the game allows the player to attempt to selectively control the selection of a random number from a spinning wheel or spinning indicia about a stationary wheel on which the indicia of numbers are positioned. The player's position is fully automated with a money acceptor(s), prize dispenser(s) which, dependent upon their function, dispense an award in the form of tickets, coins, tokens, or printed receipts, a display which informs the player of the amount in his bank, the amount of points accumulated, and the quantity of cards played,, a bar code reader which reads a bar code on a playing card, this information being stored in random access memory (RAM) and confirmed to the control panel that the card is in play, and a start button, and a stop button utilized by the player in an attempt to selectively control the random selection of numbers on the wheel located at the control panel, and a call button for assistance. Two additional buttons perform replay and cancel functions.

Applicant has fully automated what was once a manual operation which allows the player to interact in the game itself in attempting to start and stop the spinning indicia or wheel in order to obtain the desired random number while at the same time providing the operator with a complete readout of the identity and number of cards being played for a particular game, the amount of money which has been deposited to play the particular game, and which can further set the amount of the payout for a particular game based on the number of players and deliver to the appropriate players the indicia of their winning in the form of a ticket(s), coin(s), token(s), printed receipt(s) or credit.

The benefits of the system are that the operator now has greater control over the game from the standpoint of having an instantaneous readout and knowledge of the number of players, the number of cards in play and the amount of money deposited. The operator also has an instantaneous checkouts with respect to the validity of a win as a result of the bar code reader reading the identity of the card and storing the contents of that card in the RAM.

The player has a more interactive interest in the game since the player from his playing position attempts to start and stop the wheel based on the random numbers on the player's playing card in an attempt to obtain the numbers which the player needs, in order to complete the required line or pattern. As will be explained hereafter, the system is designed so that a plurality of players will be attempting to start and stop the wheel at a predesignated location which will provide the particular player with the number which he or she desires. However, the system is controlled such that only one signal from one player desk will be selected in order to control the wheel.

OBJECTS OF THE INVENTION

An object of the present invention is to provide for an interactive amusement game in which the player anticipates in an attempt to exert an element of skill over the selection of a randomly generated number, thereby skewing the random selection process.

Another object of the present invention is to provide for a novel interactive amusement game in which the player's playing position is fully automated to accept the player's money as consideration for playing the game and to dispense an award if a player should be a winner.

A still further object of the present invention is to provide for a novel, interactive amusement game in which the player's playing position contains a visual display informing the player of the size of his playing bank and the amount of the award owed to him and the amount of money designated for and quantity of cards selected for the immediate game being played.

A still further object of the present invention is to provide for a novel, interactive amusement game in which the player's playing position contains a means for the player to attempt to start and stop a wheel to control the selection of random numbers.

A still further object of the present invention is to provide for a novel, interactive amusement game which provides the operator with an instantaneous readout on all aspects of the game being conducted including, but not limited to, the number of players, the number of cards being played, the amount of money deposited, and the amount of the award associated with the particular game based upon the foregoing information.

SUMMARY OF THE INVENTION

An interactive amusement game and redemption system in which a central processing unit, control panel, and a plurality of players' desks are interconnected such that the player's desk will accept the player's money consideration for playing the games and dispense awards to the player if successful as well as provide the player with an instantaneous display of the amount of his bank and the amount of his award and also including a means for the player to attempt to influence the selection of a random number, the system also providing the operator with an instantaneous readout of the number of players playing a particular game, the amount of money deposited on the particular game, and the amount of the award dispensed from the particular game as well as setting the total quantity of the award to be dispensed for a particular game based upon the amount deposited and the number of cards in play.

BRIEF DESCRIPTION OF THE DRAWINGS

These and other objects of the present invention will become evident upon consideration of the specification herein and the illustrations attached hereto in which.

DETAILED DESCRIPTION OF THE DRAWINGS

Figure 1:
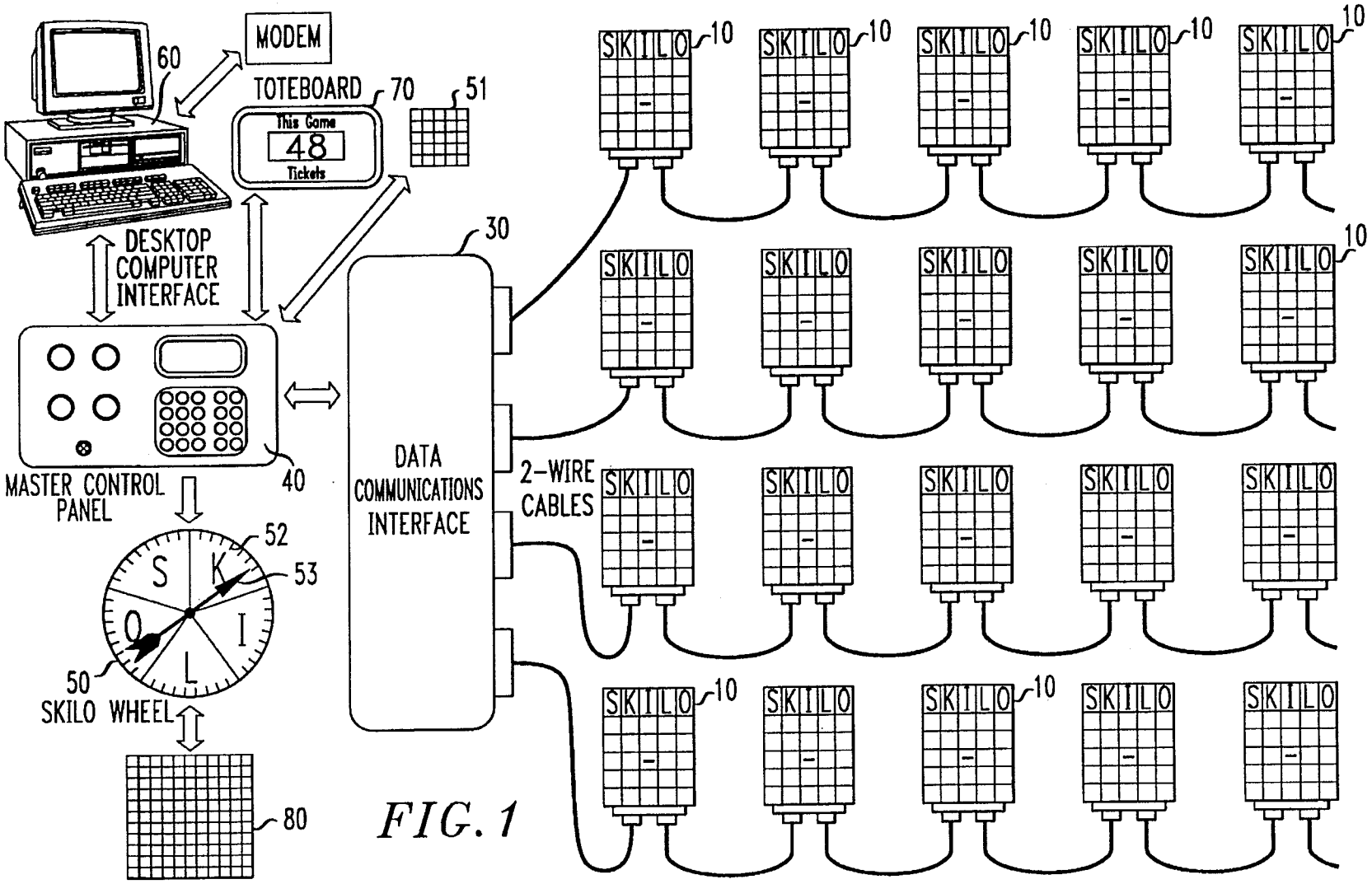
FIG. 1 is a schematic drawing of the interactive amusement game and redemption system.

FIG. 1 is a schematic illustrating the interconnection of a player's desk 10 with a communication interface 30, the main control panel 40, and the electrically-operative random number generator 50 which preferably comprises a vertically-oriented wheel having a series of indicia 52 oriented about its circumference selectively alignable with identifying indicia 523 for identifying a selected random number.

Figure 2:
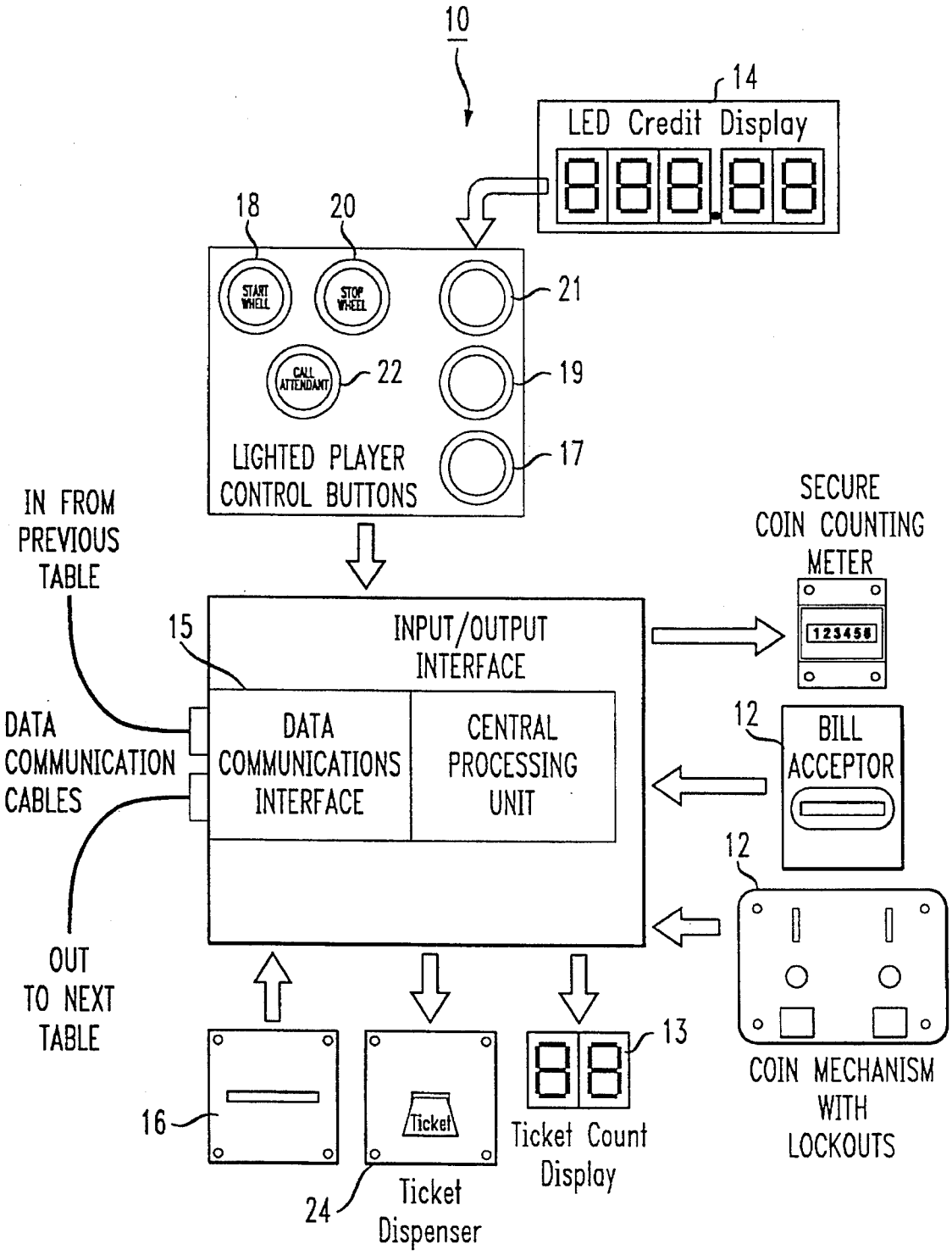
FIG. 2 is a schematic of the interactive player's position.

Referring to the player's position 10, a schematic of the elements positioned therein is illustrated in FIG. 2. In actual operation, there would be a plurality of players' desks 10 interconnected or daisy-chained together with a central connection running to the communication interface 30 and main control panel 40 and random number generator 50. These desks as schematically illustrated in FIG. 1 would be positioned in front or about the main control panel where the operator or caller, as he was referred to in the manual version of Bingo, would be positioned.

Referring again to FIG. 2, each player's desk would have a money acceptor(s) 12 for the acceptance of paper currencies and/or coin and/or electronic or magnetic coded facsimiles of such currencies. The coin or paper currency acceptor would include an enclosed secure receptacle for receiving the currency and maintaining it in a secure fashion until collected by an attendant. The money acceptor(s) 12 would be interconnected with a display 14 which would inform the player of the amount of money in his bank.

Alternately, there might be no means of accepting money consideration at the players desk. Instead, money would be accepted by the operator or an attendant who would then, via the control panel, remotely credit the players desk with the amount of such money consideration.

Each desk would have a plurality or selection of playing cards displaying, in the preferred configuration, a five by five grid with random numbers positioned thereon. Such grid might be greater or smaller than five by five. Each playing card would have its individual bar code.

After having deposited money in the money acceptor(s) 12, the player's display 14 would indicate the amount of money in his bank. The player would then select the card or cards which he wished to play. He would scan the bard code through a bar code reader 16. The cost of the card or cards would be deducted from the player's bank and the display 14 would indicate the reduction in the players bank based on the number of playing cards scanned, and indicate the amount of money the player was utilizing for the game. The amount of money deposited in the money acceptor(s) 12 and the number and identity of the playing cards scanned through bar code reader 16 would automatically be communicated to the communication interface 30 and the main control panel 40 by means of a processing unit and data interface 15 located at each table. In this manner, the operator knows the number of cards in play for each game and the amount of money deposited in the player's bank.

Each player's desk 10 has its own distinct, encoded identity, such that the operator can know the total number of cards played by all players in all positions or the operator can selectively determine the play at a single position. This encoded identity is of particular importance with respect to the distribution of the award at the conclusion of the game as will be discussed hereafter. Further, each player's desk 10 would have a plurality of control buttons located thereon as will be hereinafter described in detail. Certain of these buttons will have a light associated therewith which will signal the player when the particular button is enabled from the master control panel 40.

Once all players had deposited money in the money acceptor(s) 12 and scanned the desired number of playing cards through bar code reader 16, the operator would indicate the commencement of the game. Players would start the rotation of the random number generator 50 by depressing a start button 18 and then attempt to stop the random number generator 50 from rotation such that an indicia on the random number generator 50 would be in alignment with identifying indicia 53. The player would attempt to stop the random number generator 50 by depressing stop button 20. The player would be attempting to stop the random number generator 50 at an indicia which matched an indicia on the playing grid of the player's playing card. The communication interface 30 and master control panel 40 are designed such that while a plurality of players may all be attempting to depress stop button 20 on different indicia, the central processing unit 30 and master control panel 40 will allow only one signal to the wheel.

The indicia chosen on random number generator 50 would then be called out or visually communicated to the players who would mark their playing cards where appropriate. The operator would then release the wheel to repeat the process.

The first player to obtain a vertical, horizontal, or diagonal line of random numbers on the playing grid of the playing card or obtain the pattern specified at the start of the game would call out. The operator would then stop the random number generator 50 by overriding the start buttons 18 at the various players' desks, and the winning player would depress call button 22 so that an attendant can visually verify the player's playing card and/or the winning cards(s) can be electronically verified.

Once verified, the operator would dispense the award dependent upon the number of players and number of cards in play for the particular game. At each player's desk, there is located a prize dispenser(s) 24 which would dispense, dependent upon their function, the award in the form of tickets, coins, tokens, or printed receipts. Once a winner was verified, the operator, from the master control panel 40, can command the dispensing of the award and this signal from the master control panel is sent to the appropriate player's desk and only the appropriate player's desk who is a winner as a result of the encoded distinct identity of each player's desk. The prize dispenser(s) 24 would then dispense the appropriate valued award to the player. The value of the award would also be displayed on the visual display 13. Note that there can be more than one winning player in each game. In these cases, the winning points are distributed to each winning player's desk; the award is rounded up, if necessary, to allow for equal distribution.

As an alternate method of dispensing the award, the operator could elect to credit the award to the players' bank.

In this configuration, the tickets, coins, tokens, or printed receipts would not be issued until the player pressed a collect button 21 located at the players' desk.

At this point in time, a new game would commence and the scan button light 19 would illuminate signaling players to enter the card identities. If a player still had a remaining balance in his bank as depicted on the display 14, the player could then select his playing cards for the new game and scan them through the bar code reader 16 or depress the repeat button 17 which would identify the cards being played as those from the previous game. Alternately, the player could signal the operator to remove the money from the player's bank and issue a refund for the unplayed amount. The display 14 would then indicate a decrease in the bank balance of the player based on the number of cards scanned or refund issued and all of the information would be communicated from each individual player's desk to the communication interface 30 and to the master control panel 40.

The system allows the operator from the master control panel 40 to control automatically, the costs being charged for the playing cards and the award for which the players are competing. For example, if the operator wished to encourage more play, the operator can automatically reduce the cost for the playing card or program the system to offer three playing cards for the price of two. Further, since the operator can get an instantaneous readout of the amount of cards being scanned for a particular game, the operator can raise or lower the amount of the award for which the players are competing.

Additionally, the system can include a central processing unit in the form of a desktop computer 60 interconnected with the main control panel 40 for the storage of data regarding all of the games played for analysis of play and player information and for the maintenance of bookkeeping and accounting aspects of the system.

Figure 3:
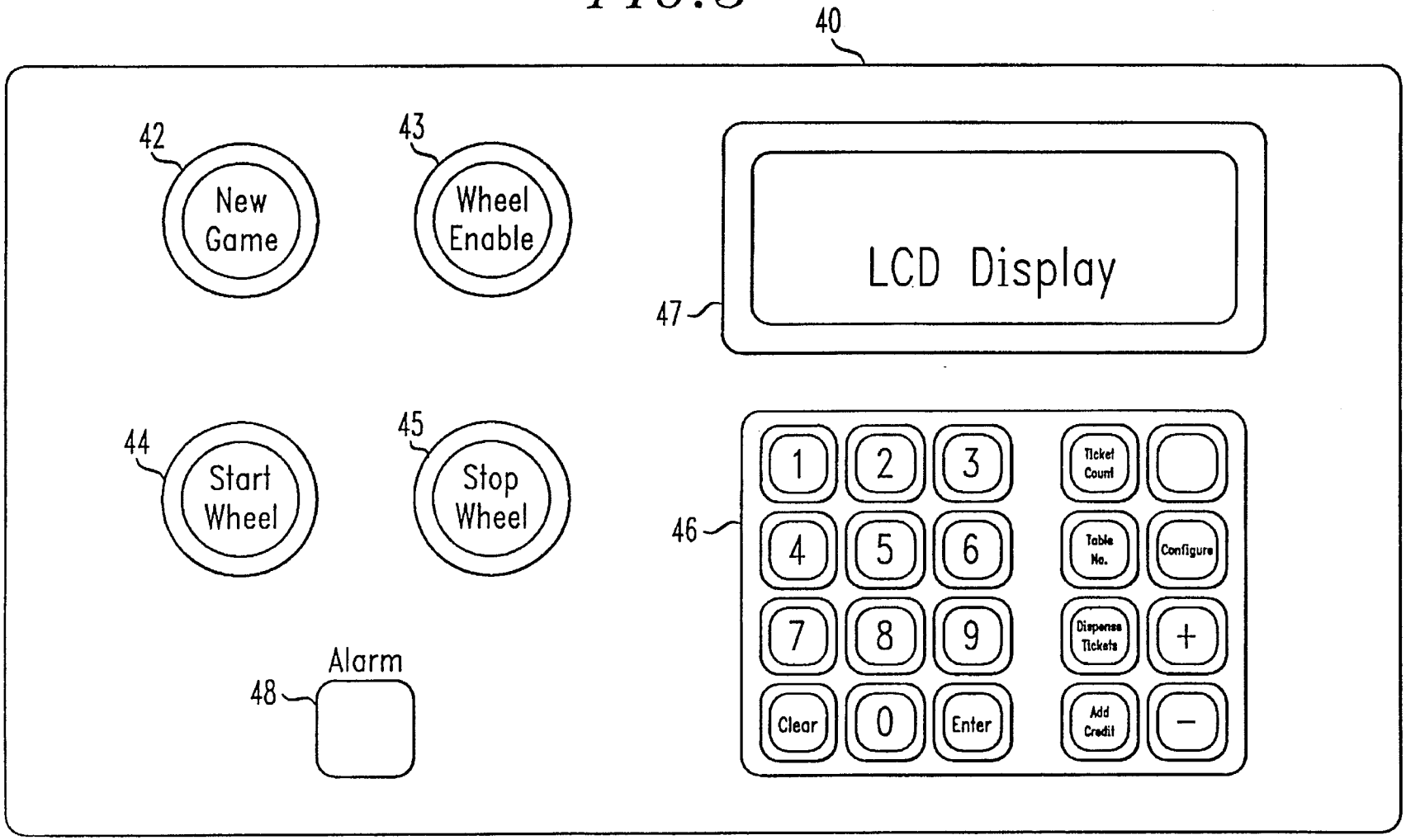
FIG. 3 is a top view of a schematic illustration of the master control board.

FIG. 3 is a schematic of the main control panel 40. The main control panel 40 would have a new game button 42 which would clear out all of the old data in preparation for the commencement of a new game and illuminate scan button 19 at player's desk 10 to signal the player to enter the card codes. It should be noted that this data could still be maintained in the central processing unit 60. The wheel enable button 43 enables the start wheel lamps and buttons at the player's desk 10. The start wheel button 44 allows the master controller to apply power to the random number generator 50 to commence its spin. The stop wheel button 45 is an override to signal the master controller to turn off the power to the wheel. The numeric key pad 46 allows entry of information required to dispense the award to winning players at their location and may be used for system configuration, diagnostics or control other features. A visual display 47 shows current status information and facilitates data entry with the key pad. An alarm 48 can also be incorporated at the main control panel which can alert the operator to certain conditions during the play of the game.

In a typical game scenario, the operator would press the new game button 42 which would permit new players to deposit monies in the money acceptor(s) 12 in order to obtain playing credits. New players and existing players would then scan their playing cards across the card reader 16 which would automatically decrease the amount of credit displayed on the player's display. After a proper amount of time, the operator would press the wheel enable button 43 at the main control panel which would extinguish the scan button light and cause the start wheel lights 18 at the player's desk to illuminate. At this time, the main control panel is now waiting for someone to press a start wheel button 18 at their player's position 10. Any start wheel buttons 18 held down in anticipation of the wheel enable signal will be ignored.

As soon as a start wheel button 18 is pressed and the signal acknowledged, the light on the start wheel button 18 at all players' positions 10 will extinguish. The accepted signal will commence the rotation of the random number generator 50. The master controller will signal the stop wheel lamps to illuminate sometime after the random number generator has started spinning. This signal can be based on a randomly generated timer. The stop wheel lamps will be illuminated and all stop wheel buttons 20 at the player's position 10 will be enabled. The main control panel now awaits a signal from a stop wheel button 20. When a stop wheel button 20 is pressed and the signal is received, all stop lamps are turned off and the control panel commences to stop the wheel. The operator would then announce the number which has been generated and commence the process again if no winner was identified. This sequence would commence with the operator pressing the wheel enable button.

Once a winner had been determined, the award would be dispensed as per the prior description and the new game button would be enabled by the operator allowing the players to deposit monies and scan playing cards.

This system would include security and redundancy capability in that playing information and status would be stored not only in the master controller but in the data communications interface and central processing unit 15 at each desk. The system may also include a visual tote board 70 to identify to players the amount of the award that they are competing for, a flash board 80 which displays the selected numbers, as well as a pattern board 51 which is an illuminated mock up of the actual playing cards, the pattern board visually displaying the row, column, or pattern which the players are attempting to complete.

While the invention has been described with reference to its preferred embodiment thereof, it will be appreciated by those of ordinary skill in the art that various changes can be made to the process and apparatus without departing from the basic spirit and scope of the invention.

What is claimed is:

1. An automated, interactive amusement game and redemption system for a plurality of players wherein said players attempt to start and stop a random number generator at desired indicia to match an indicia on a player's playing card and forming a predetermined pattern, said game comprising:

a plurality of players' desks, interactively connected with a master control board and a random number generator, each of said players' desks comprising:

means for accepting monetary consideration and establishing a player's bank;

a plurality of said playing cards, coded, and in the form of a grid having random indicia positioned on said grid;

a code scanner for reading said code on said playing cards and establishing scanned cards as active for the current game;

a prize dispenser for dispensing the award;

a means for starting said random number generator;

a means for stopping said random number generator;

a player's desk central processing unit for storage of data generated from said means for accepting monetary consideration, said code reader, and said price dispenser, a visual display for displaying the status of a player's bank, said price dispenser; and said active cards; and a data interface in communication with said player's desk central processing unit and said master control board for communicating said data to said master control board, said master control board comprising:

a means for signaling each player's desk of the start of said interactive amusement game;

a means for enabling said random number generator;

an entry pad for control and configuration of said interactive amusement game;

a means for directing and dispensing of said award at selected players' desks; and a means for communicating with a master control board central processing unit for storage of said game data communicated from said players' desk central processing units.

2. The automated, interactive amusement game in accordance with claim 1 wherein each of said players' desks has positioned therein, a separate encoded switch permitting said master control board to monitor said data at said players' desks and to direct the dispensing of the award to players' desks.

3. The automated, interactive amusement game in accordance with claim 1 wherein said means for signaling said players' desk for the start of said interactive amusement game comprises an enabling button in communication with said players' desks from said master control board for enabling said means for accepting monetary consideration and said code scanner and signaling such enablement to players by an illumination means positioned on said players' desks.

4. The automated, interactive amusement game in accordance with claim 1 wherein said means for starting said random number generator and means for stopping said random number generator at said players' desks comprise a start button and a stop button enabled by said master control panel.

5. The automated, interactive amusement game in accordance with claim 1 wherein each player's desk has positioned thereon, a replay button permitting a player to replay the active playing cards of the previous game, said replay button automatically adjusting said player's bank.

6. The automated, interactive amusement game in accordance with claim 1 wherein said player's desk has positioned thereon, a cancel button permitting a player to cancel any of the active playing cards prior to the start of said automated interactive amusement game, said cancel button automatically adjusting said player's bank.

7. The automated, interactive amusement game in accordance with claim 1 wherein said random number generator comprises a wheel having indicia in the form of numerals positioned about the circumference of said wheel, said wheel having a selection indictor, said selection indictor or said wheel spinning in response to said means for starting said random number generator positioned at said player's desk and stopping pursuant to said means for stopping said random number generator positioned at said player's desk.

8. The automated, interactive amusement game in accordance with claim 1 wherein said means for directing and dispensing of said award from said master control board to said prize dispenser at said player's desk comprises said entry pad in conjunction with said encoded switch at said player's desk to permit said prize dispenser to dispense said award.

9. The automated, interactive amusement game in accordance with claim 1 wherein said master control board contains a means for starting and stopping said random number generator.

* * * * *